US005456441A

United States Patent [19]

Callies

[11] Patent Number: 5,456,441

[45] Date of Patent: Oct. 10, 1995

[54] ADJUSTABLE POST BASE

[75] Inventor: Gerald Callies, New Prague, Minn.

[73] Assignee: United Steel Products Company, Montgomery, Minn.

[21] Appl. No.: 2,745

[22] Filed: Jan. 11, 1993

[51] Int. Cl.[6] ..... F16M 13/00

[52] U.S. Cl. ..... 248/521; 52/714; 52/295

[58] Field of Search ..... 248/156, 530, 248/532, 533, 519, 529, 521, 522, 219.2; 52/714, 295

[56] References Cited

U.S. PATENT DOCUMENTS

| | | | |
|---|---|---|---|
| 395,766 | 1/1889 | Westphal | 248/521 |
| 1,736,177 | 11/1929 | Snook | 248/530 X |
| 2,184,192 | 12/1939 | McCline et al. | 248/530 X |
| 2,607,398 | 8/1952 | Andrews | 248/156 X |
| 2,652,999 | 9/1953 | Lohmar | 248/42 |
| 3,178,142 | 4/1965 | Koch | 248/156 |
| 3,413,773 | 12/1968 | Fitzgerald | 52/295 |
| 3,823,785 | 7/1974 | Toliver | 248/156 X |
| 3,858,833 | 1/1975 | Fink | 248/533 |
| 4,387,543 | 6/1983 | Tschan et al. | 52/295 |
| 4,995,206 | 2/1991 | Colonias et al. | 52/714 X |
| 5,011,107 | 4/1991 | Reece | 248/156 X |
| 5,082,231 | 1/1992 | Knowles | 248/530 X |
| 5,222,703 | 6/1993 | Ricciardelli | 248/156 X |

*Primary Examiner*—Ramon O. Ramirez
*Assistant Examiner*—Korie H. Chan
*Attorney, Agent, or Firm*—Dorsey & Whitney

[57] ABSTRACT

The present invention relates generally to the field of construction hardware, and more particularly, to an adjustable post base for supporting a construction post relative to a concrete footing or the like. The invention also relates to a method for manufacturing such an adjustable post base.

16 Claims, 2 Drawing Sheets

ADJUSTABLE POST BASE

BACKGROUND OF THE INVENTION

1. Field of the Invention

The present invention relates generally to the field of construction hardware, and more particularly, to an adjustable post base for supporting a construction post relative to a concrete footing or the like. The invention also relates to a method for manufacturing such an adjustable post base.

2. Description of the Prior Art

Post bases of the type to which the present invention relates are useful in the construction of decks, porches and the like. Such post bases typically include an anchor member designed to be embedded in a concrete footing or the like and a seat member connected with the anchor member and including means for connection to the lower end of a support post. In situations where post bases are used in the construction of a deck, porch or the like, a concrete footing is poured and, while the concrete is still wet, the anchor member of the post base is immersed in the concrete to a position where the seat member is properly positioned to receive a support post. Such post bases enable the lower end of the post to be slightly elevated, thus minimizing rot and other deterioration of the post. The post base also functions to insure proper placement of the post and to connect the post to the footing.

In many of these post bases, the seat portion is welded to the anchor member. A manufacturing process that utilizes welding has several limitations. First, a structure in which the seat is welded to the anchor prevents rotation or other relative movement between such elements. Thus, if the rotational position of the anchor is not properly aligned initially, it cannot be adjusted after the concrete has hardened. This requires added positioning time when setting the anchor in the wet concrete.

Secondly, welding usually dictates the use of non-galvanized steel since the welding of galvanized steel liberates toxic fumes. Thus, if galvanized steel is welded, expensive ventilation and safety precautions are required non-galvanized steel is subject to rust and oxidation, thus limiting the useful life of the anchor. The welding of the preferred galvanized steel also results in a contaminated weld with reduced weld strength.

Some post bases have eliminated the use of welds by connecting the seat to the anchor through a punch process. In this process the anchor is extended through an opening in the seat member and punched to form a connection between the seat member and the anchor. A drawback which continues to exist, however, with this particular process is that the seat is not rotatable. Consequently, although the welding requirement has been eliminated the adjustability problem has not been solved.

Construction projects with which post bases are used require precise measurements. Further, the post bases must be set into the fresh concrete with precise orientation so that when the concrete hardens, the seat will be properly aligned to receive the bottom end of the post. If for some reason the seat is not properly aligned, it is difficult, and sometimes impossible, to utilize that post base. Any repair or correction necessarily involves removal of the post base from the footing and subsequent resetting of the post base with the seat in proper orientation or undesireable twisting of the post to match the improper orientation of the seat. Accordingly, there is a need for a non-welded, rotationally adjustable post base and a process to manufacture such a post base.

SUMMARY OF THE INVENTION

In contrast to the prior art, the present invention provides a post base in which the seat is rotatably connected to the anchor member. Such a structure totally eliminates welding and also provides a base in which the rotational orientation of the seat can be adjusted after the concrete has set to accommodate the particular orientation of the post. With the elimination of all welding, the structure of the present invention also enables the post base to be constructed of galvanized steel.

The process for manufacturing the post base of the present invention involves a process whereby a portion of the anchor is expanded on each side of the seat to rotatably capture the seat between such expanded portions. The process is accomplished through the use of a progressive tool and die mechanism.

It is therefore an object of this invention to provide a post base in which the seat member is rotationally adjustable relative to the anchor.

A further object of the present invention is to provide a rotationally adjustable post base without welding.

A further object of the invention to provide a method for manufacturing the adjustable post base described above.

These and other objects will become apparent with reference to the drawings, the description of the preferred embodiment and method and the appended claims.

DESCRIPTION OF THE PREFERRED EMBODIMENT

Figure 1:
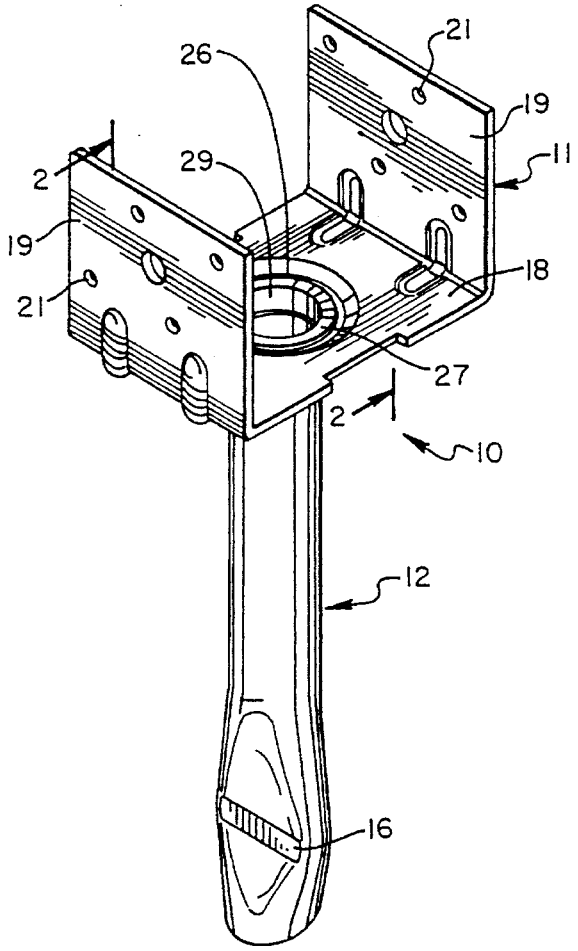
FIG. 1 is a perspective view of the adjustable post base of the present invention.
Figure 2:
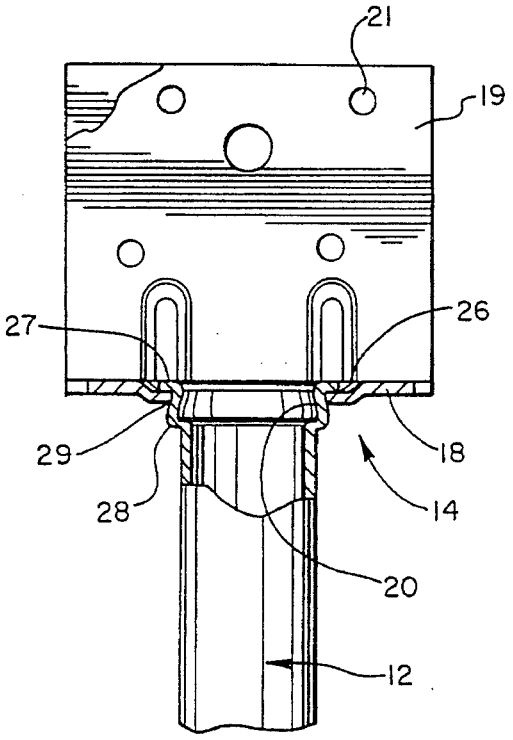
FIG. 2 is a view, partially in section, of the adjustable post base as viewed along the section line 2—2 of FIG. 1.
Figure 3:
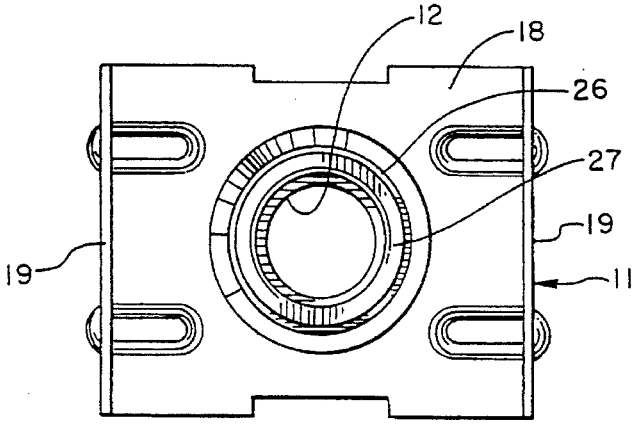
FIG. 3 is an elevational top view of the adjustable post base.
Figure 7:
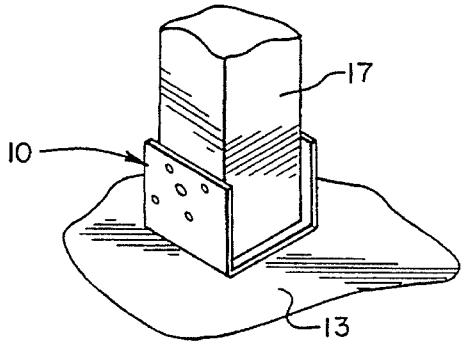
FIG. 7 is a perspective view showing the post base embedded in concrete and a support post connected to the post base.

With reference first to FIG. 1, 2 and 3, the post base 10 comprises a seat member 11 and an anchor 12. The seat 11 is rotatably connected to the anchor 12 at the seat receiving portion 14. When used, the post base 10 is embedded in a concrete footing 13 (FIG. 7) and the seat 11 receives a post 17, such as a support post used in the construction of decks and porches. The post base 10 can support the post 17 at the concrete level and at various limited elevated positions.

As best seen in FIG. 1, the anchor 12 is a generally elongated, hollow tubular member comprising a top and a bottom end. Although other cross-sectional shapes are possible, the anchor is preferably cylindrical at its top portion. The top end of the anchor 12 includes a seat receiving portion 14 for rotatably receiving the seat 11.

The anchor 12 is adapted for retention in a medium such as concrete. Therefore the length of the anchor 12 is sufficiently long to support the seat 11 in its load-bearing capacity and, if elevation is desired, to support the seat at such elevated levels. Preferably, the anchor 12 is designed to elevate the seat 11 as high as three inches above the concrete.

The lower end of the anchor 12 includes means 16 to assist in retaining the anchor 12 within the concrete. The preferred means 16 embodies a crimp in the anchor 12 to form a narrowed portion to prevent the anchor 12 from being pulled out of the concrete and to resist twisting after the post 17 is rotated into its final position and the concrete has hardened. Various other means are available in the art for performing this function.

As illustrated, the anchor 12 is hollow throughout its length and is preferably seamless. Although the benefits of the present invention may also be achieved with a hollow anchor having a seam, the seamless construction prevents the anchor from splitting during the manufacturing process.

With continuing reference to FIGS. 1—3, the seat 11 has a base 18 and a pair of side flanges 19 integrally formed with, the base 18. The side flanges 19 extend upwardly from, and form a 90° angle with, the base 18. The base 18 receives the bottom end of the support post 17 (FIG. 7) and the side flanges 19 engage the sides of the post. In the preferred embodiment, the side flanges 19 are connected with opposite side edges of the base 18 and lie in generally parallel planes. Although the preferred embodiment discloses a pair of flanges 19, the advantages of the present invention can also be obtained with a single flange. A plurality of nail receiving openings 21 are provided in the side flanges 19 to assist in connecting the seat 11 to the post 17.

The seat 11 has a center opening 20 in the base 18 to receive the seat receiving end of the anchor 12. Preferably the opening 20 is larger than the diameter of the anchor 12 and is surrounded by a depression or recessed area 26. The depression 26 accommodates one of the expanded portions of the anchor 12, namely the expanded portion 27. When fully formed, the expanded portion 27 sits in the depression or recess 26 so that the top surface of the portion 14 is flush with the top surface of the base 18.

As shown best in FIG. 2, the seat receiving portion 14 of the anchor 12 comprises a first expanded portion 27, a second expanded portion 28 and a third expanded portion 29. The first and second expanded portions 27, 28 are expanded to a diameter greater than the diameter of the opening 20 and are positioned on the top and bottom sides of the seat base 18 so as to capture the base 18, and thus the seat 11, therebetween. The third expanded portion 29 is expanded to a diameter approximately equal to that of the opening 20. In the preferred embodiment, the expanded portion 28 forms a collar which is spaced from the top end of the anchor 12, while the expanded portion 27 comprises an outwardly extending upper edge of the anchor 12. The third expanded portion 29 is positioned between the first 27 and second 28 expanded portions. The above structure facilitates limited rotational movement of the seat 11 relative to the anchor 12.

Figure 4:
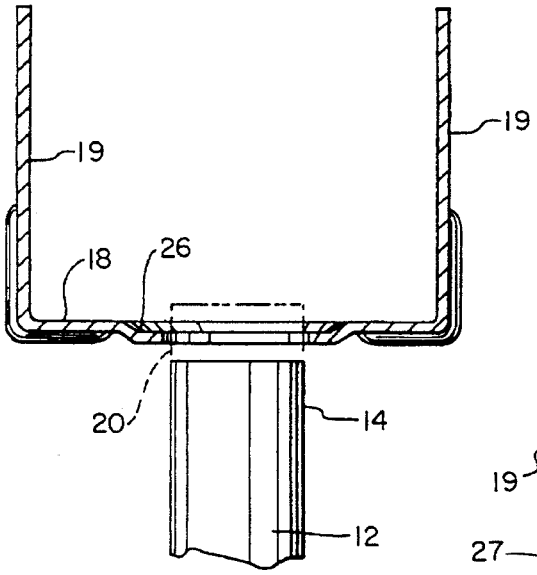
FIG. 4 is a side view, partially in section, of the seat and anchor components prior to connection.
Figure 5:
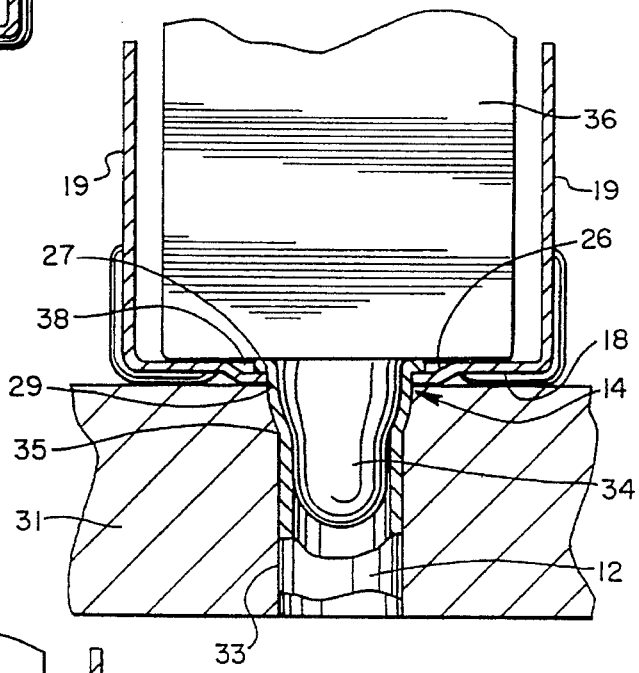
FIG. 5 is a side view, partially in section, of a first sequence in the process of connecting the seat to the anchor in accordance with the present invention.
Figure 6:
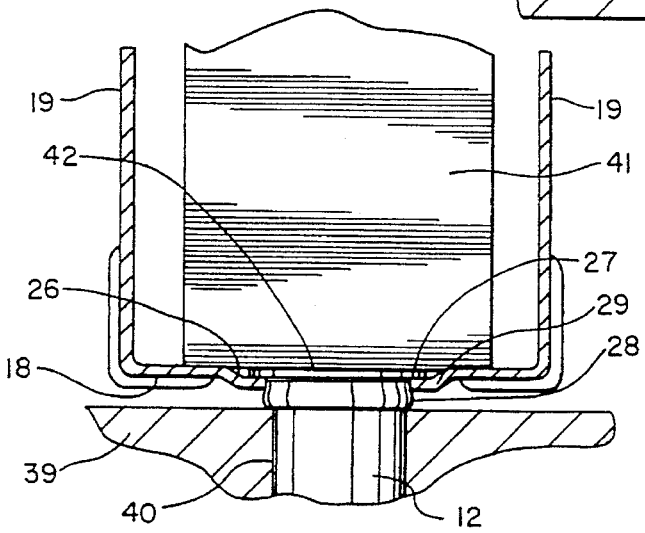
FIG. 6 is a side view, partially in section, of a second sequence in the process and showing the completed post base.

Having described the structure of the preferred embodiment, the process for making the post base of the present invention can be understood with reference to FIGS. 4, 5 and 6. In general the process involves the rotatable connection of two components, a seat 11 and an anchor 12. Through a punch process, portions of the anchor 12 are expanded on the top and bottom sides of the seat base 18 to rotatably capture the seat 11. This process results in a fully formed post base 10 having an anchor and a rotatably adjustable seat. Preferably the seat 11 is pre-formed with a center opening 20, a depression 26 surrounding the opening 20, and at least one side flange 19, while the upper end of the anchor 12 is generally hollow and cylindrical with a diameter less than that of the opening 20. This allows the insertion of the anchor 12 into the opening 20 during the manufacturing process.

Referring to FIG. 4, the process begins by aligning the anchor 12 and the seat 11 and by inserting the upper end of the anchor 12 through opening 20. This defines the seat receiving portion 14. Next, the anchor 12 is inserted into a cylindrical bore 33 of a die 31 (FIG. 5). The depth of the bore 33 allows the bottom end of the anchor 12 to be supported so that its upper end is above the upper surface of the seat base 18. As shown in FIG. 5, the diameter of the bore 33 is slightly larger than the diameter of the anchor 12. The upper end of the bore 33 is provided with an enlarged or flared portion 35.

After positioning the anchor 12 in the bore 33, a punch 36 having a punch tool 34 is aligned with the die so that the tool 34 is aligned with the top end of the anchor 12. Downward pressure is then applied to the punch 36. This causes movement of the tool 34 into the open end of the anchor 12, causing the top end of the anchor to expand into the configuration defined by the top end 35 of the bore 33 and into engagement with the inner edge of the opening 20. As the punch 36 approaches the end of its downward movement, the bottom surface 38 engages the top edge of the anchor 12 and causes such edge to bend outwardly to form the flange or expanded portion 27. As shown, the lower end of the tool 34 has a diameter substantially equal to the inner diameter of the anchor tube 12, while the upper end of the tool 34 has a configuration conforming to the upper end 35 of the bore 33, but with a slightly smaller diameter.

The punch 36 is then withdrawn and the preliminarily expanded anchor 12 and partially connected seat 11 are removed from the bore 33 and positioned in the bore 40 (FIG. 6) of a second die 39. The bore 40 is an elongated bore of equal diameter throughout and has a depth sufficient to support the anchor 12 at the position illustrated in FIG. 6.

A second punch 41 having a flat bottom punch surface 42 is then moved downwardly into engagement with the anchor 12 and seat 11 as shown in FIG. 6. Engagement of the surface with the expanded flange 27 and continued downward movement of the punch 41 causes the portion of the anchor 12 below the seat base 18 to further expand into the expanded portion or collar 28 as shown. The collar 28 forms as a result of such downward movement and resistance of the anchor resulting from support of the anchor tube 12 at the bottom of the bore 40 and/or engagement between the lower edge of the collar and the top surface of the die 39.

The downward movement of the punch 41 is terminated at the position shown in FIG. 6. This results in a post base having a seat 11, an anchor 12 and means in the form of the expanded portions 27 and 28 for rotatably capturing the seat 11 and thus rotatably connecting it to the anchor 12.

Although the description of the preferred embodiment has been quite specific, it is contemplated that various modifications may be made without deviating from the spirit of the present invention. Accordingly, it is intended that the scope of the present invention be dictated by the appended claims rather than by the description of the preferred embodiment.

I claim:

1. A post base for supporting a construction post relative to a concrete footing or the like comprising:

an anchor member having an anchor end adapted to be embedded in a concrete footing and an opposite seat receiving end;

a seat for receiving said construction post, said seat comprising a base having a top side, a bottom side and an opening extending therethrough; and non-threaded connection means for rotatably connecting said seat to said anchor member at said seat receiving end about an axis perpendicular to said base, said connection means having a portion extending through said opening and including first and second expanded portions positioned on said top side and said bottom side of said base, respectively, each of said expanded portions having dimensions greater than said opening whereby said first and second expanded portions are precluded from passing through said opening.

2. The post base of claim 1 wherein said anchor member is a hollow tubular member.

3. The post base of claim 1 wherein said base comprises at least one side flange.

4. The post base of claim 3 wherein said side flange includes a plurality of connection openings.

5. The post base of claim 1 wherein said anchor member includes a hollow, generally cylindrical top end having a diametrical outer dimension and wherein the diameter of said opening is larger than the diametrical outer dimension of said anchor.

6. The post base of claim 1 wherein said anchor includes a means for securing the anchor in concrete.

7. The post base of claim 1 wherein said seat receiving portion further comprises a third expanded portion disposed between said first and second expanded portions and in engagement with said opening.

8. The post base of claim 1 wherein said base includes an area surrounding said opening which is recessed on said top side to accommodate one of said first and second expanded portions such that said one expanded portion lies at or below the plane formed by said top side of said base.

9. The post base of claim 1, wherein said first expanded portion comprises a flanged portion of the top end of said anchor and said second expanded portion comprises an expanded collar spaced from the top end of said anchor.

10. The post base of claim 13 wherein each of said first and second expanded portions is continuous throughout its entire periphery.

11. The post base of claim 1 wherein said top side of said base is generally planar and includes a recessed area surrounding said opening to accommodate one of said first and second expanded portions.

12. The post base of claim 1 wherein said seat includes a pair of spaced, generally parallel side flanges extending from said base at right angles, each of said side flanges having a plurality of nail receiving openings.

13. The post base of claim 1 wherein said opening is circular with a diametrical dimension.

14. The post base of claim 13 wherein each of said first and second expanded portions includes a dimension greater than said diametrical dimension.

15. The post base of claim 14 wherein each of said first and second expanded portions is continuous throughout its entire periphery.

16. A support post construction comprising:

a concrete footing;

a post base for supporting a construction post including;

an anchor member having an anchor end embedded in said concrete footing and an opposite seat receiving end, a seat for receiving a bottom end of a construction post, said seat comprising a base and at least one side flange having nail receiving connection openings, and a connection means for rotatably connecting said seat to said anchor member at said seat receiving end and a construction post supported by said base and being connected to said side flange by a plurality of nails.

* * * * *